US011976486B1

(12) United States Patent
McElroy, Jr. et al.

(10) Patent No.: US 11,976,486 B1
(45) Date of Patent: May 7, 2024

(54) HIGH-DENSITY SUB-SURFACE COLUMBARIUM

(71) Applicants: Robert Cecil McElroy, Jr., Lady Lake, FL (US); James Alvin McElroy, Jr., Hattiesburg, MS (US)

(72) Inventors: Robert Cecil McElroy, Jr., Lady Lake, FL (US); James Alvin McElroy, Jr., Hattiesburg, MS (US)

( * ) Notice: Subject to any disclaimer, the term of this patent is extended or adjusted under 35 U.S.C. 154(b) by 0 days.

(21) Appl. No.: 18/188,046

(22) Filed: Mar. 22, 2023

(51) Int. Cl.
*E04H 13/00* (2006.01)

(52) U.S. Cl.
CPC ..... *E04H 13/006* (2013.01)

(58) Field of Classification Search
CPC ..... E04H 13/00; E04H 13/003; E04H 13/006; E04H 13/008
See application file for complete search history.

(56) References Cited

U.S. PATENT DOCUMENTS 3,529,730 A 9/1970 Thompson
3,726,052 A * 4/1973 Thompson ..... E04H 13/003 52/27
3,898,718 A * 8/1975 Eubank ..... E04H 13/00 27/29
3,940,894 A * 3/1976 Nunes ..... E04H 13/008 52/129
4,669,236 A 6/1987 Martin
4,977,652 A * 12/1990 Graham ..... E04H 13/006 27/35
5,647,108 A * 7/1997 Crook ..... E04H 13/006 27/DIG. 1
6,055,793 A * 5/2000 Irwin ..... A61G 17/08 53/436
6,167,600 B1 1/2001 Williams et al.
6,250,025 B1 6/2001 Darby
6,421,890 B1 7/2002 Biggar
7,478,461 B2 * 1/2009 Glass ..... A61G 17/007 27/35
7,739,776 B2 6/2010 Hume
7,908,800 B2 3/2011 Bach Lahor
7,926,228 B1 4/2011 Snow
7,937,814 B2 5/2011 Voit
8,209,918 B1 7/2012 Voit
8,438,794 B2 5/2013 Eickhof
8,966,725 B2 * 3/2015 Langelier ..... A61G 99/00 27/35

(Continued)

FOREIGN PATENT DOCUMENTS

DE 202014007213 U1 * 11/2014 ..... E04H 13/008
EP 0312472 A1 * 4/1989

OTHER PUBLICATIONS

Machine translation of EP 0312472, accessed from PE2E-SEARCH FIT database Dec. 7, 2023. (Year: 2023).*

*Primary Examiner* — Christine T Cajilig
(74) *Attorney, Agent, or Firm* — Dunlap Bennett & Ludwig, PLLC; Anna L. Kinney

(57) ABSTRACT

A high-density sub-surface columbarium system includes a storage apparatus with a row of cylindrical containers embedded within a burial plot. Each cylindrical container has a longitudinal axis positioned vertically. A cap is mounted on each cylindrical container at a top surface of the burial plot. The system uses new and existing cemetery plots and incurs no additional above-ground perpetual maintenance cost.

10 Claims, 4 Drawing Sheets

(56) References Cited

U.S. PATENT DOCUMENTS

| | | | | |
|---|---|---|---|---|
| 9,261,598 | B1 * | 2/2016 | Robinson | E04H 13/008 |
| 9,290,960 | B1 * | 3/2016 | McHale | E04H 13/00 |
| 10,422,151 | B1 | 9/2019 | Garcia | |
| 10,487,529 | B2 | 11/2019 | Tollefson et al. | |
| 10,604,959 | B2 | 3/2020 | Eickhof et al. | |
| 2010/0037490 | A1 * | 2/2010 | Scruggs | A61G 17/044 37/189 |
| 2012/0267427 | A1 * | 10/2012 | Ahee | E04H 13/003 235/375 |

* cited by examiner

HIGH-DENSITY SUB-SURFACE COLUMBARIUM

BACKGROUND OF THE INVENTION

The present invention relates to storage of cremated remains and, more particularly, to a high-density sub-surface columbarium.

Currently, the US cremation rate is approximately 60% and this rate is increasing because of funeral costs and burial plot costs. Cemeteries are running out of land and construction costs are problematic. Perpetual care costs are increasing. Thus, surface columbarium facilities are faced with several issues.

As can be seen, there is a need for a less expensive means of reverently storing cremated remains.

SUMMARY OF THE INVENTION

In one aspect of the present invention, a high-density sub-surface columbarium system comprises a storage apparatus having a row of cylindrical containers embedded within a burial plot, each cylindrical container having a longitudinal axis positioned vertically; and a cap mounted on each cylindrical container at a top surface of the burial plot.

The present invention provides below ground interment using new and existing cemetery plots and incurs no additional above-ground perpetual maintenance cost. This technology benefits the cemetery by producing additional income. A subsurface columbarium may also be used for a high-density burial community, e.g., for family and friends.

These and other features, aspects and advantages of the present invention will become better understood with reference to the following drawings, description, and claims.

DETAILED DESCRIPTION OF THE INVENTION

Figure 1:
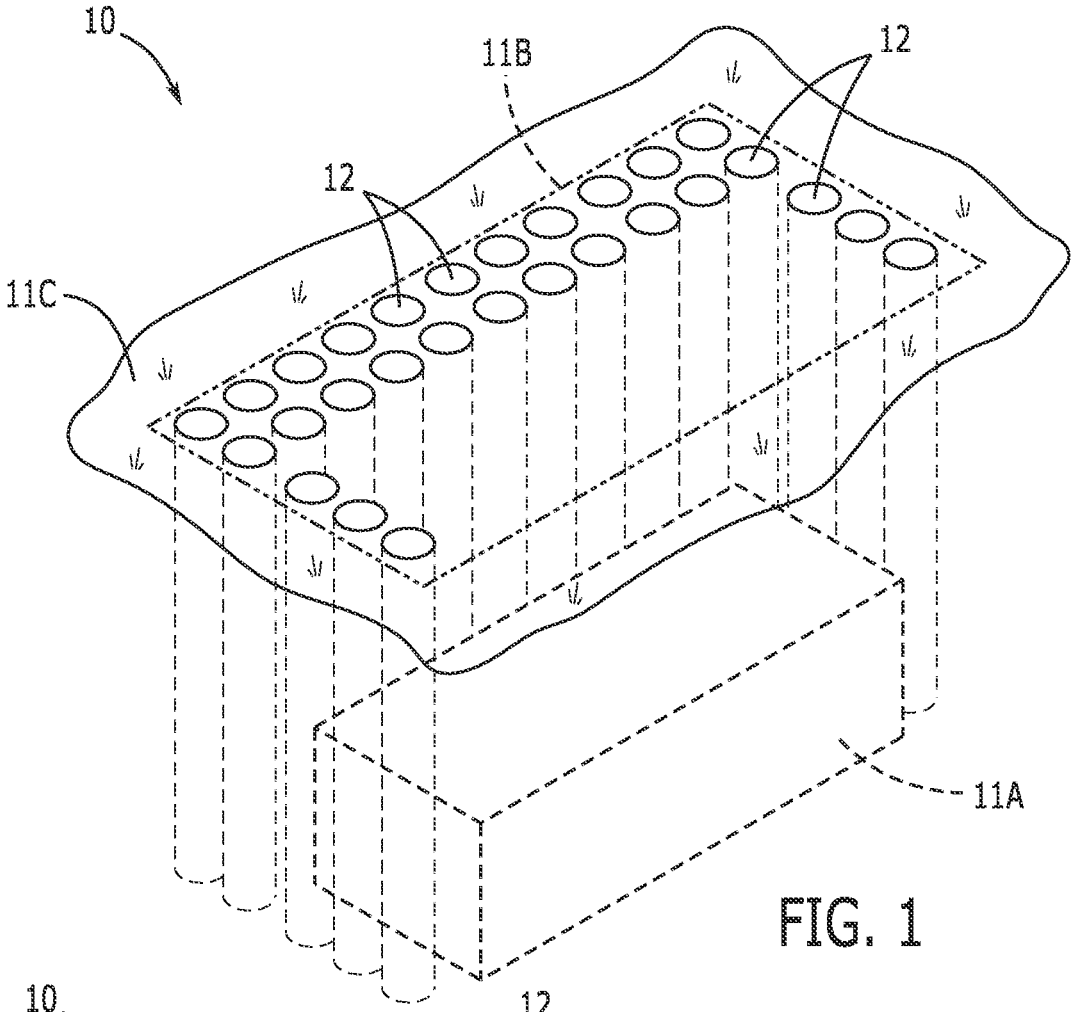
FIG. 1 is a top perspective view of a columbarium according to an embodiment of the present invention.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a high-density sub-surface columbarium, i.e., a storage apparatus for cremated remains and/or aqua cremated remains, sometimes referred to herein as a Cremains Interment Vault Interment System (CIVIS).

A subterranean support structure is provided with individual cylinders or multicylinder units (also referred to herein as CIVIS cylinders). A CIVIS may be constructed in a standard cemetery grave plot below the surface of the ground as a permanent feature, incorporating the CIVIS cylinders. As determined based on installation site soil and environmental conditions, the cylinders may be secured in place by an integrated permanent frame or by way of soil stabilization. Cylinder stabilization may require additional ballast weight to be added to each cylinder or cylinder group. Precast structural weight may be adjusted for installation site soil and environmental conditions.

Individual urns or contained cremains may be placed into each CIVIS cylinder. Individual cylinders may contain cremains containers for a group, such as multiple family members or individuals with shared interests.

The high-density sub-surface columbarium system may be installed by a variety of methods. Individual cylinder(s) may be installed with an auger. Cylinder groups may be installed after excavation. Individual cylinders may be secured together, e.g., with polyvinyl chloride (PVC) pipe fittings or the like or in a precast concrete structure, to maintain cylinder group structural integrity.

The CIVIS cylinders and multi-cylinder interment structures may have any length, diameter, and integrity suitable for placement in a specified burial location. Each cylinder has a longitudinal axis, generally positioned vertically in a burial plot. They may be constructed of any suitable material, such as but not limited to a material selected from the group consisting of PVC pipe, metal cylinders, pre-cast concrete, concrete aggregate, cast iron, steel and steel alloys, nonferrous, plastic or lined pipe, 3D printed, and any combination thereof. The components may be manufactured by any suitable production method, such as casting, extrusion, injection molding, or 3D printing.

This subsurface, high-density, cremains interment technology effectively repurposes existing grave sites for new burials and provides a high-density interment community for new burial sites. The inventive columbarium is a permanent high-density facility as a final location for cremation and aqua cremation remains.

In some embodiments, subsurface cylinders may be placed above a burial vault, provided the vault is sufficiently deep.

The columbarium or cemetery facility may have an identification directory with a permanent record of each cylinder interment or interment structure. Each cylinder or cylinder group may have a radio frequency identification device (RFID) tags or similar device, records of which may be included in the cemetery's historic record for identification and location of each interred individual as a memorial in perpetuity. The identification directory may document the RFID tags with their locations and the deceased's identity in each location.

Figure 2:
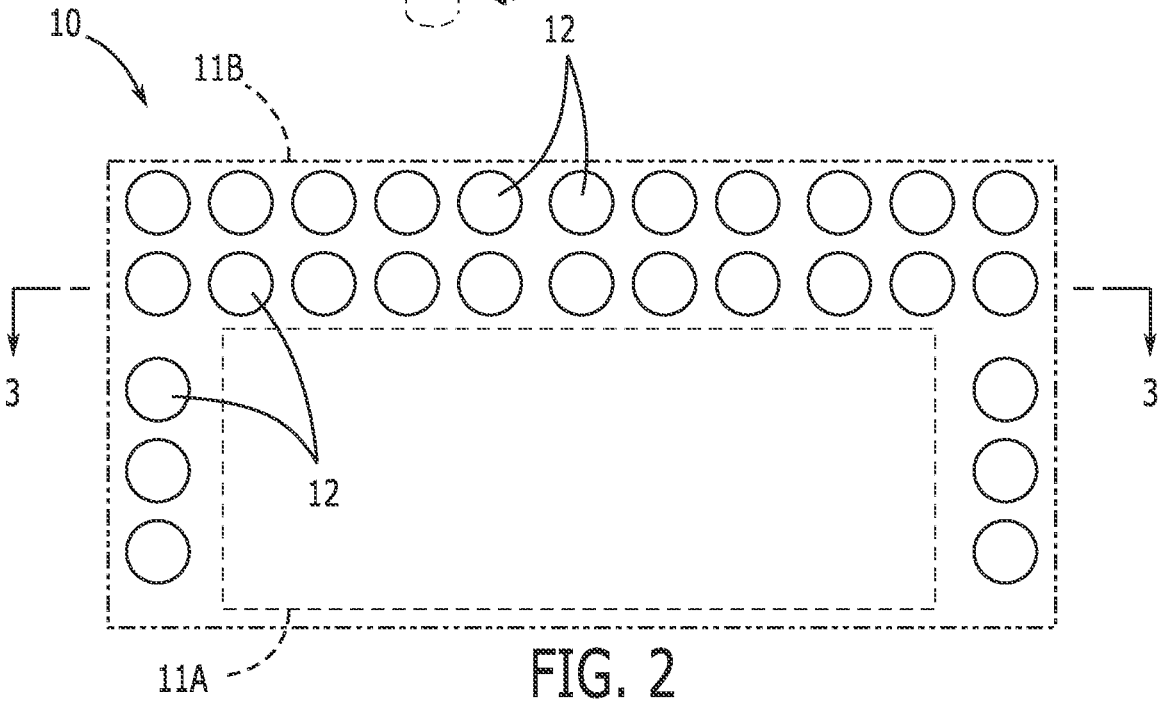
FIG. 2 is a top plan detail view thereof
Figure 3:
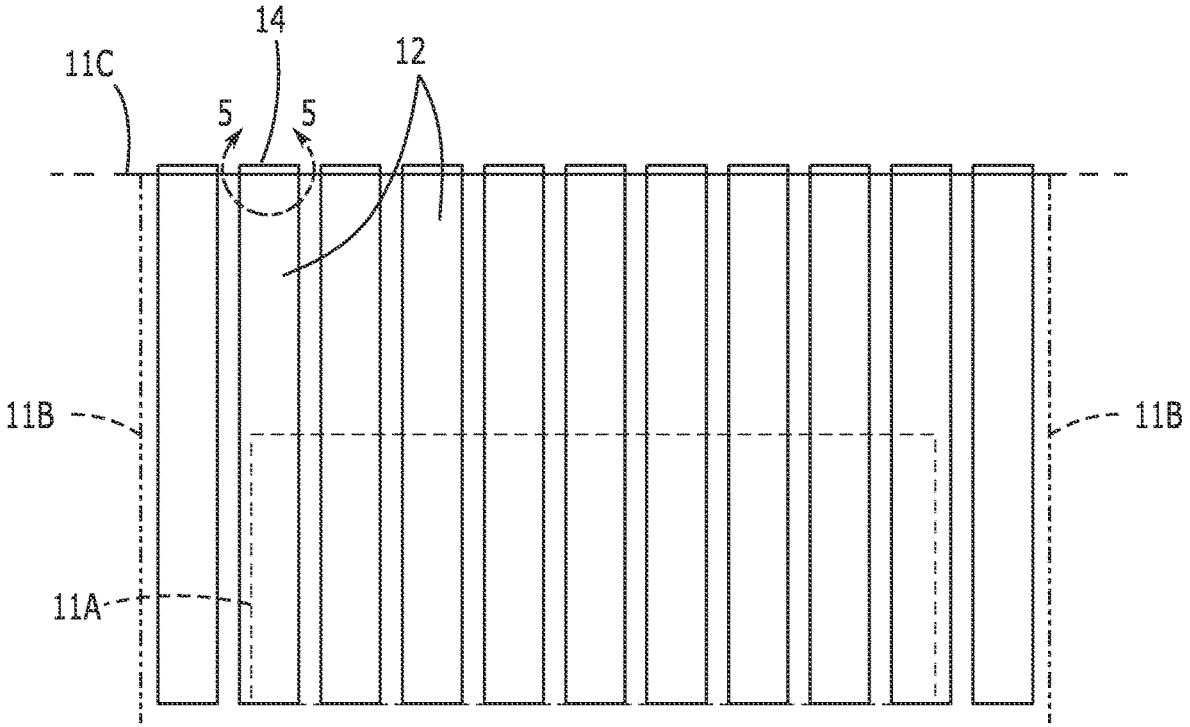
FIG. 3 is a cross-sectional view thereof, taken along line 3-3 on FIG. 2.
Figure 4:
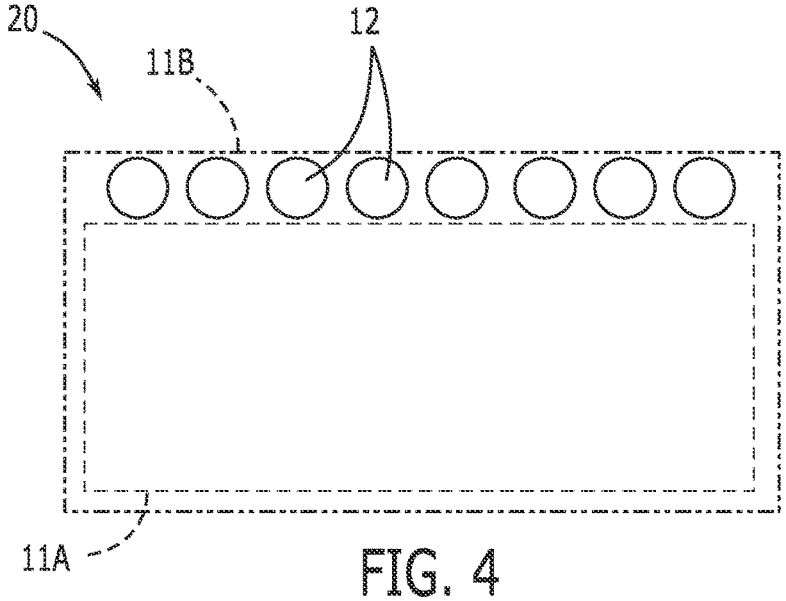
FIG. 4 is another top plan detail view thereof.
Figure 5:
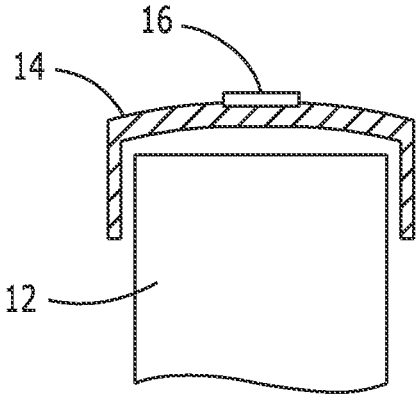
FIG. 5 is a cross-sectional view thereof, taken along line 5-5 on FIG. 3.

Referring to FIGS. 1 through 8, FIGS. 1 and 2 illustrate a columbarium 10 according to an embodiment of the present invention, having a plurality of individual interment cylinders 12 placed below ground surface 11C, positioned between an existing burial vault 11A and its predetermined plot boundaries 11B. FIGS. 1 and 2 illustrate multiple rows of cylinders 12 adjacent to the burial vault 11A on 3 sides. As shown in FIGS. 3 and 5, each interment cylinder 12 is sealed with an interment cylinder cap 14 having an affixed or embedded RFID transponder tag 16 to assist a visitor in locating a loved one or identifying a deceased person in a particular location. Alternatively, an RFID responder may be affixed to an upper-level row of cylinders, as shown in FIG.

7. Individual cremains in each cylinder in the upper level and in the lower level may be identified in the electronic record for the cemetery.

A columbarium 20 according to another embodiment of the present invention is shown in FIG. 4, having a single row of cylinders 12 adjacent one side of a burial vault 11A.

Figure 6:
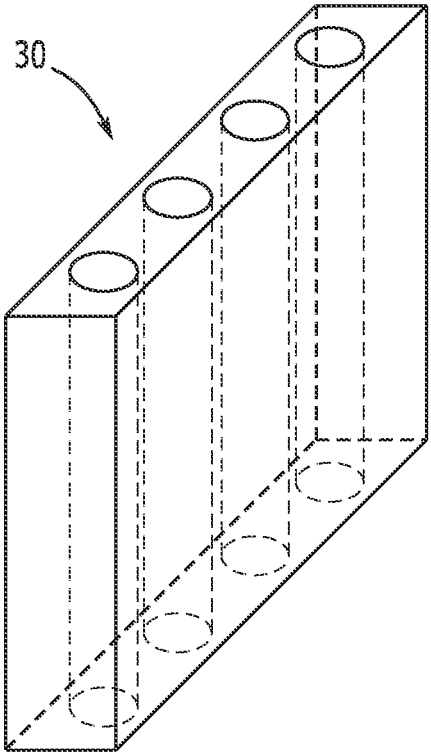
FIG. 6 is a perspective detail view thereof.

FIG. 6 shows a columbarium 30 according to yet another embodiment of the present invention, having a precast structure with a plurality of cylindrical apertures 12, the structure being dimensioned for accommodation between the burial vault 11A and its predetermined plot boundaries 11B. In the example shown in FIG. 6, the columbarium 20 structure is rectangular with a predetermined length, width, and depth. The columbarium 30 may be manufactured with tubes encased in concrete, such as polyvinyl chloride (PVC) tubes. Alternatively, the columbarium 30 may be manufactured with tubes formed in cast concrete using tubular forms.

Figure 7:
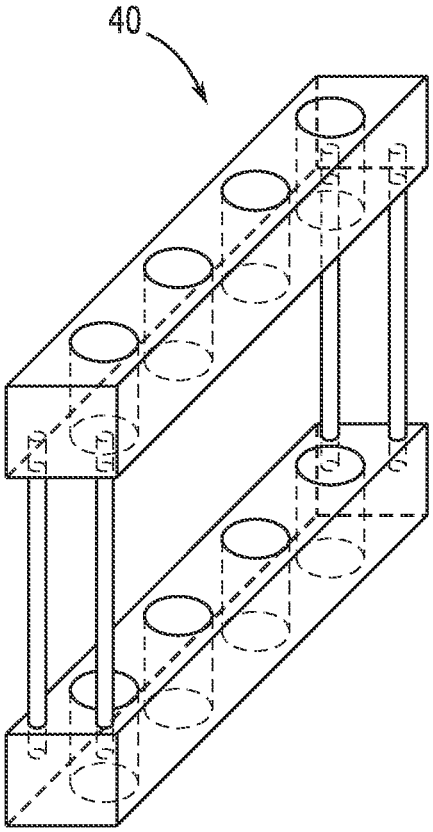
FIG. 7 is a perspective detail view thereof.

In some embodiments, as shown in FIG. 7, a columbarium 40 having a multi-component structure 40 may include cylindrical apertures in rows and/or columns to individually accommodate a plurality of cremated remains. In the example shown in FIG. 7, the columbarium 40 structure has two horizontal rectangular components, each having a series of cylindrical apertures side by side. The two horizontal rectangular components are spaced apart by a pair of columns, legs, or rods on each end. The components of the columbarium 40 may be assembled as a unit and installed or may be installed as individual pieces, e.g., one horizontal row at a time, with columns installed to separate the rows, depending upon location and installation requirements.

Figure 8:
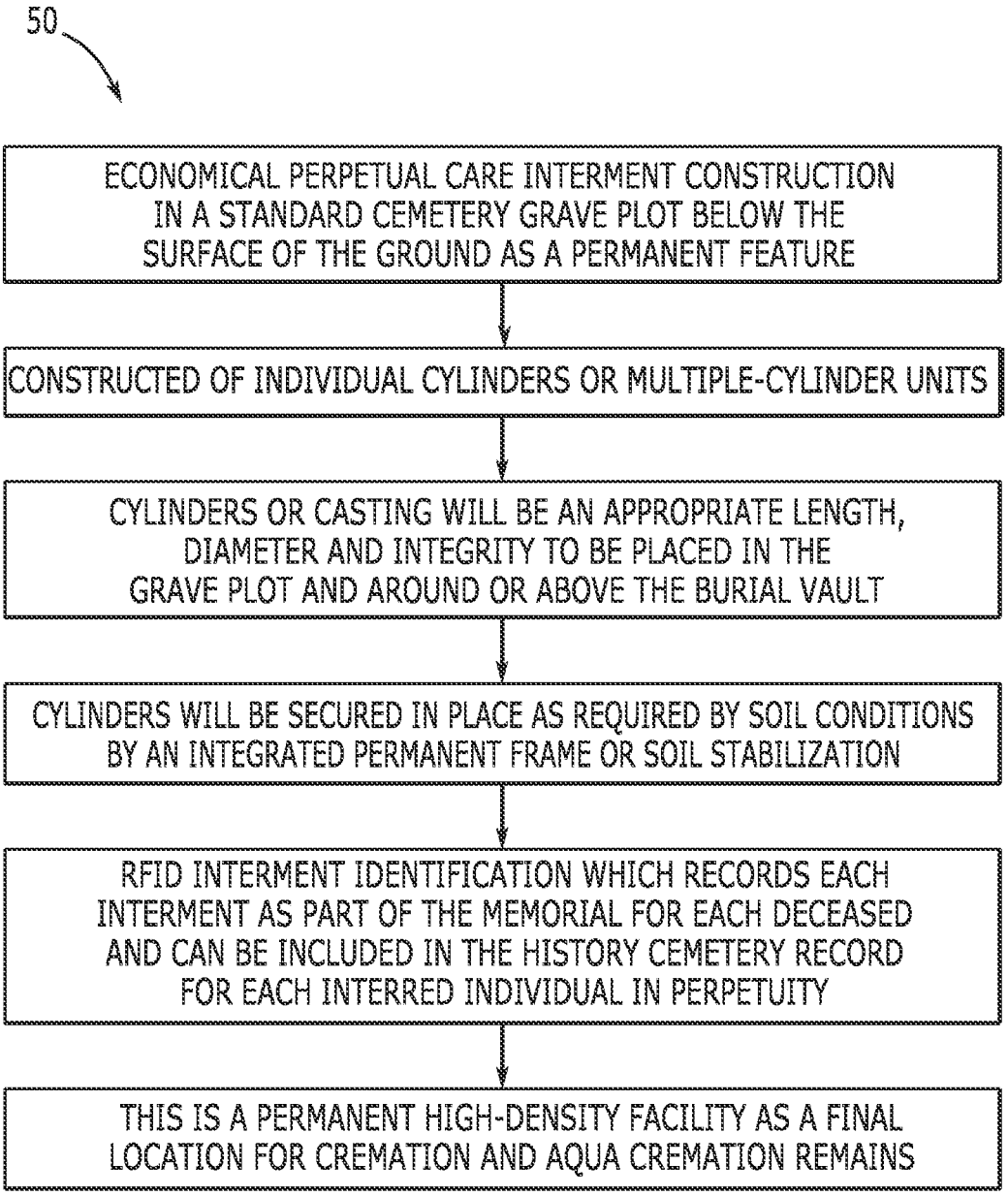
FIG. 8 is a flowchart of a process according to an embodiment of the present invention.

FIG. 8 shows a flowchart 50 summarizing features and benefits of the inventive columbarium.

It should be understood, of course, that the foregoing relates to exemplary embodiments of the invention and that modifications may be made without departing from the spirit and scope of the invention as set forth in the following claims.

What is claimed is:

1. A high-density sub-surface columbarium system, comprising:

a storage apparatus having a row of cylindrical containers embedded within a burial plot having an existing grave containing a vault, each cylindrical container having a longitudinal axis positioned vertically; and a cap mounted on each cylindrical container at a top surface of the burial plot.

2. The high-density sub-surface columbarium system of claim 1, wherein the cylindrical containers are individual containers.

3. The high-density sub-surface columbarium system of claim 1, wherein the cylindrical containers are positioned above the vault.

4. The high-density sub-surface columbarium system of claim 1, further comprising an integrated frame having a plurality of laterally spaced columns vertically separating the row of cylindrical containers from at least one other row of cylindrical containers.

5. The high-density sub-surface columbarium system of claim 1, wherein the row of cylindrical containers is a monolithic multicylinder unit with spaced apart vertical apertures over which each cap is mounted.

6. The high-density sub-surface columbarium system of claim 5, wherein the multicylinder unit comprises more than one row.

7. The high-density sub-surface columbarium system of claim 1, wherein the cap has a lip encircling the cylindrical container and has an affixed or embedded radio frequency identification device.

8. The high-density sub-surface columbarium system of claim 7, wherein the embedded radio frequency identification device is documented in an identification directory.

9. A method of installing the high-density sub-surface columbarium system of claim 1, comprising:

excavating the burial plot;

installing the row of cylindrical containers; and stabilizing the row of cylindrical containers.

10. The method of claim 9, wherein the step of excavating the burial plot is performed using an auger.

* * * * *